US012747643B1

(12) United States Patent
MacKay et al.

(10) Patent No.: US 12,747,643 B1
(45) Date of Patent: Sep. 29, 2026

(54) SINGLE-LIFT WIRELINE INTERVENTION UNIT FOR OFFSHORE WELLS

(71) Applicant: Expro North Sea Limited, Dyce (GB)

(72) Inventors: Ceohilan MacKay, Aberdeen (GB); William Milne, Aberdeen (GB)

(73) Assignee: Expro North Sea Limited, Dyce (GB)

( * ) Notice: Subject to any disclaimer, the term of this patent is extended or adjusted under 35 U.S.C. 154(b) by 0 days.

(21) Appl. No.: 19/257,096

(22) Filed: Jul. 1, 2025

(51) Int. Cl.
*E21B 19/00* (2006.01)
*E21B 15/00* (2006.01)

(52) U.S. Cl.
CPC ..... *E21B 19/008* (2013.01); *E21B 15/00* (2013.01)

(58) Field of Classification Search
CPC ..... E21B 19/008; E21B 15/00
See application file for complete search history.

(56) References Cited

U.S. PATENT DOCUMENTS

2025/0122776 A1* 4/2025 Smith ..... E21B 19/22

FOREIGN PATENT DOCUMENTS

GB 2071599 A * 9/1981 ..... B66C 23/18

* cited by examiner

*Primary Examiner* — James G Sayre
(74) *Attorney, Agent, or Firm* — Getz Balich LLC

(57) ABSTRACT

A system for performing offshore wireline interventions includes a telescopic mast, a wireline drum mounted onto the mast, a pressure control equipment (PCE) stack mounted on a side portion of the mast, one or more wireline valves mounted on a front portion of the mast, and one or more lubricators mounted along the mast.

20 Claims, 3 Drawing Sheets

SINGLE-LIFT WIRELINE INTERVENTION UNIT FOR OFFSHORE WELLS

BACKGROUND OF THE DISCLOSURE

1. Technical Field

The present disclosure relates to methods and systems of wireline technology for quick and efficient well intervention techniques for accessing a wellbore.

2. Background Information

Wireline intervention operations, particularly slickline services, are routinely employed in the maintenance, monitoring, and management of oil and gas wells. Traditional offshore slickline rig-ups are large and cumbersome, comprising multiple pieces of equipment and require multiple separate containerized equipment that take anywhere from 5 to 10 lifts when moving from well to well. On busy platforms this may take up several hours of a platform crane use and create delays in wireline operations.

A miniature slickline unit (MSU) has been developed as a solution to gather relevant well data from deep in the wellbore in due time, prior to mobilizing or rigging up the full wireline spread on a given well or a number of wells on a specific platform. In addition, the MSU can perform operations which are currently executed by the full wireline spread. Examples of such activities are primarily data collection and running relevant logs and secondarily, pre-plug and abandonment including deep plug setting, and cutting or punching the tubing with associated pumping operations to kill the well, etc.

Conventionally, for example in EP0801703, the apparatus slickline is truck mounted. Onshore wireline trucks are by necessity, designed to be self-contained. Open-hole trucks can carry wireline tools and rig up gear while cased-hole trucks may feature a built-in lifting apparatus to carry needed pressure control equipment (PCE) within the truck, trailer or a second support truck. Trucks, while allowing for convenient well to well movement, are naturally heavy and only restricted by weight to the relevant road regulations for heavy goods vehicles (HGVs). Therefore, being truck mounted is a limitation of the lifting apparatus of EP0801703. There is a significant gap in the oil industry for a miniaturized and containerized system for an offshore package. The availability of offshore cranes with a preference of multiple lifts with lower individual weights does cater to certain requirements, however these offshore cranes have many limitations with respect to time losses and use of heavy equipment relying on multiple runs. Some current offshore wireline technologies feature standard units or drums placed in front of the well with a standalone mast to rig up the pressure control equipment and hang the sheave off to run wire into the well.

SUMMARY

According to an aspect of the present disclosure, provided is a mast incorporated with a wireline drum having the ability to transport the PCE stack for short lifts in one lift. The mast incorporated with a wireline drum having the ability to transport the PCE stack for short lifts in one lift may allow for quick and efficient movement from well to well during well intervention campaigns, minimizing the down time of the deck crew moving the wireline equipment and allow further independence of the wireline crew, thus leading to improved efficiency and safety. Consequently, there is a need for development of a compact, integrated slickline intervention system that minimizes equipment footprint, reduces lifting requirements, and enhances operational efficiency for offshore well interventions. According to one or more embodiments, further provided is a concept of a miniature slickline unit for offshore use. One or more embodiments of the present disclosure have successfully demonstrated the ability to efficiently rig-up, rig-down and to move all PCE, crane and slickline equipment from one well to the next in one lift.

According to another aspect of the present disclosure, a system for performing offshore wireline interventions, including a telescopic mast, a wireline drum mounted onto the mast, a pressure control equipment (PCE) stack mounted on a side portion of the mast, one or more wireline valves mounted on a front portion of the mast, and one or more lubricators mounted along the mast.

In any of the aspects or embodiments described above and herein, the mast may be configured to extend vertically during operation and retract into a horizontal position during transport.

In any of the aspects or embodiments described above and herein, the wireline drum may be configured to deploy at least one of one or more wireline cables, tugger lines or slicklines.

In any of the aspects or embodiments described above and herein, the PCE stack may be secured to a side portion of the mast during transport, and the wireline valves may be mounted to a front portion of the mast during transport.

In any of the aspects or embodiments described above and herein, the one or more lubricators may include a plurality of lubricators, the plurality of lubricators may be secured to either side of the mast or on opposite sides of the mast from each other.

In any of the aspects or embodiments described above and herein, the system may further include an integrated powerpack configured to supply hydraulic and electrical power to the system.

In any of the aspects or embodiments described above and herein, the mast, the wireline drum, the PCE stack, the one or more wireline valves, the one or more lubricators, and the powerpack may be integrated into a single structural frame for offshore transport as a combined unit, and the combined unit may be configured to be lifted and relocated between one or more well sites via a single crane lift.

According to another aspect of the present disclosure, an apparatus for offshore well intervention includes a structural frame including a telescopic mast movable between a vertically extended position and a horizontally retracted position, a wireline drum mounted onto the mast, a pressure control equipment (PCE) stack removably secured to a side section of the mast, one or more wireline valves mounted to a front section of the mast, a pair of lubricators mounted on to opposing lateral sides of the mast, a first tugger line configured to manipulate the PCE stack, and a second tugger line configured to operate one or more auxiliary well tools.

In any of the aspects or embodiments described above and herein, the mast may include a plurality of nested sections extending to a height of 90 feet and may be configured to retract via one or more hydraulic cylinders.

In any of the aspects or embodiments described above and herein, the wireline drum and first tugger line may be integrated and may include a spooling mechanism configured to control payout and retrieval of at least one of a wireline, a slickline, or one or more tugger lines.

In any of the aspects or embodiments described above and herein, the PCE stack may be secured to the side of the mast during transport to reduce movement and vibration of the mast during transport, and the one or more wireline valves may be mounted to the front of the mast to reduce movement and vibration of the mast during transport.

In any of the aspects or embodiments described above and herein, the pair of lubricators may be secured to either side of the mast for transport.

In any of the aspects or embodiments described above and herein, the first tugger line and second tugger line may be independently controllable for separate lifting and handling operations.

In any of the aspects or embodiments described above and herein, a powerpack may be integrated into the apparatus and may be configured to supply hydraulic and electrical power to the apparatus, and the mast, the wireline drum, the PCE stack, the one or more wireline valves, the pair of lubricators, and the powerpack may be mounted on a common frame for handling as a single transportable unit.

According to yet another aspect of the present disclosure, a method for performing offshore slickline operations includes transporting a miniature slickline unit (MSU) as a single integrated unit comprising a telescopic mast, a wireline drum, a tugger line drum, a pressure control equipment (PCE) stack, and a powerpack, positioning the MSU at a well site on an offshore platform, deploying the mast into a vertically extended position, routing a plurality of wireline cables and a plurality of tugger lines from the wireline drum and the tugger line drum over a top of the mast in the vertically extended position, operating a first tugger line of the plurality of tugger lines to lift and align the PCE stack over a wellhead, operating a second tugger line of the plurality of tugger lines to deploy and retrieve one or more auxiliary tools into a wellbore, operating one or more of the plurality of wireline cables to lower and retrieve the one or more auxiliary tools in the wellbore, and retracting the mast into a horizontal position and relocating the MSU to a next well site via a single lift upon completion of intervention.

In any of the aspects or embodiments described above and herein, in the vertically extended position, the mast may be vertically extended to a height of 90 feet via hydraulic actuation, and in a transport-ready state, the mast may be retracted into a horizontal position.

In any of the aspects or embodiments described above and herein, the operating the first tugger line may include aligning and latching the PCE stack onto a wellhead flange.

In any of the aspects or embodiments described above and herein, the second tugger line may be independently controlled and may be configured to rig-up and rig-down tool one or more downhole intervention tools.

In any of the aspects or embodiments described above and herein, the plurality of wireline cables may be independently controlled and may be configured to deploy and retrieve one or more downhole intervention tools.

In any of the aspects or embodiments described above and herein, the wireline drum may be mounted onto the mast, the PCE stack may be secured to the side of the mast, and one or more wireline valves may be mounted to the front of the mast.

In any of the aspects or embodiments described above and herein, one or more lubricators may be mounted on to opposing lateral sides of the mast to form a single-liftable unit.

In any of the aspects or embodiments described above and herein, the MSU may be a fully integrated unit and may be configured to enable transport, rig-up, and rig-down of the mast, the wireline drum, the tugger line drum, the PCE stack, the one or more wireline valves, the one or more lubricators, and the powerpack in a single lift.

The one or more embodiments of the present disclosure are designed to overcome the challenges of the current offshore slickline rig ups which are heavy equipment, include multiple separate containerized equipment and can take anywhere from 5-10 lifts when moving from well to well. On busy platforms this may take up hours of a platforms crane use and delay wireline operations. By consolidating the mast, wireline drum, pressure control equipment (PCE), and associated lifting accessories into a single, self-contained unit, the system may significantly minimizes downtime typically associated with disassembling, transporting, and re-rigging conventional wireline setups. This miniature slickline unit or mini slickline unit (MSU) may allow for quick and efficient relocation from one well to the next during offshore well intervention campaigns. The ability to perform single lift moves may greatly reduce reliance on platform cranes, freeing up critical deck resources and minimizing disruption to other ongoing operations. Furthermore, the one or more embodiments may enhance the operational autonomy of the wireline crew, enabling them to conduct rig-up, rig-down, and well to well relocation with minimal support from the platform deck crew. This independence may contribute to improved efficiency, reduced non-productive time and better alignment with the fast-paced scheduling demands of offshore well intervention campaigns.

The one or more embodiments of the present disclosure employ a unique miniature slickline unit (MSU) that may be designed for both compact transport and efficient operation. The MSU may be positioned at a selected well site on an offshore platform, such that the unit is aligned with the well centerline and secured to the platform or a designated base structure to ensure operational stability. During operation, the unit may be configured in a deployed or operational state, providing flexibility for use in space-constrained offshore environments while maintaining full slickline intervention capability. In this state, a structural frame including a telescopic mast may be fully extended using hydraulic cylinders, reaching a height of approximately 90 feet and secured with locking mechanism, allowing for effective access to the wellbore for standard slickline operations. The wireline cables, tugger lines or slickline may be routed upwards passing over a crown sheave positioned at the top of the mast. A first tugger line may be configured to manage movement and positioning of the main pressure control equipment (PCE) stack, and a second tugger line may be configured to assist in handling auxiliary components, including but not limited to tool strings or retrieval tools. A powerpack may be incorporated within the assembly, essential for supplying hydraulic and electrical power to the system. This arrangement may enable efficient well intervention while minimizing spatial and logistical constraints on offshore platforms.

The one or more embodiments of the present disclosure may further allow a transport-ready state. In this state, the telescopic structure of the mast may retract using hydraulic cylinders and folds down into a horizontal position, forming a compact and stable configuration suitable for lifting and relocating the entire mini slickline unit (MSU). The wireline drum may be securely mounted onto the mast, providing balanced weight distribution and ease of access for subsequent deployment. The pressure control equipment (PCE) stack may be secured to the side and wireline valves to the front of the mast, while the lubricators are fastened to either side of the mast frame. This organized, modular arrangement may enable the entire slickline system including mast, wireline drum, PCE and powerpack to be moved in a single, short lift from one well to another, eliminating the need for multiple cranes lifts and further reduces the delayed wireline operations.

The one or more embodiments of the present disclosure may enable an offshore operator to perform wireline operations while minimizing the use of platform crane resources, thereby significantly enhancing the overall efficiency of wireline intervention campaigns. A key advantage of the one or more embodiments is the substantial reduction in the number of lifts required to transport and set up the equipment. Traditional offshore slickline operations often involve multiple discrete lifts, commonly ranging from five to ten, to relocate wireline components such as the mast, pressure control equipment (PCE), wireline unit, and auxiliary gear between wells. In contrast, the integrated system of the one or more embodiments of the present disclosure may consolidate these components into a single, transportable assembly.

The one or more embodiments of the present disclosure aims to achieve all the above benefits without employing the cumbersome and time-consuming techniques of conventional methods of using standard units or drums placed in front of the well with a standalone mast to rig-up the pressure control equipment and hang the sheave off to run wire into the well. Hence, a miniature slickline unit for offshore use, which has the ability to move all pressure control equipment (PCE), crane and slickline equipment from one well to the next, in a single lift is achieved.

The foregoing summary is intended merely to introduce a subset of the features more fully described in the following detailed description. Accordingly, this summary should not be considered as limiting.

BRIEF DESCRIPTION OF DRAWINGS

The accompanying drawings, which are incorporated in and constitutes a part of this specification, illustrates one or more embodiments of the disclosure and together with the description, serves to explain the principles of the present disclosure. In the figures.

DETAILED DESCRIPTION

Figure 1:
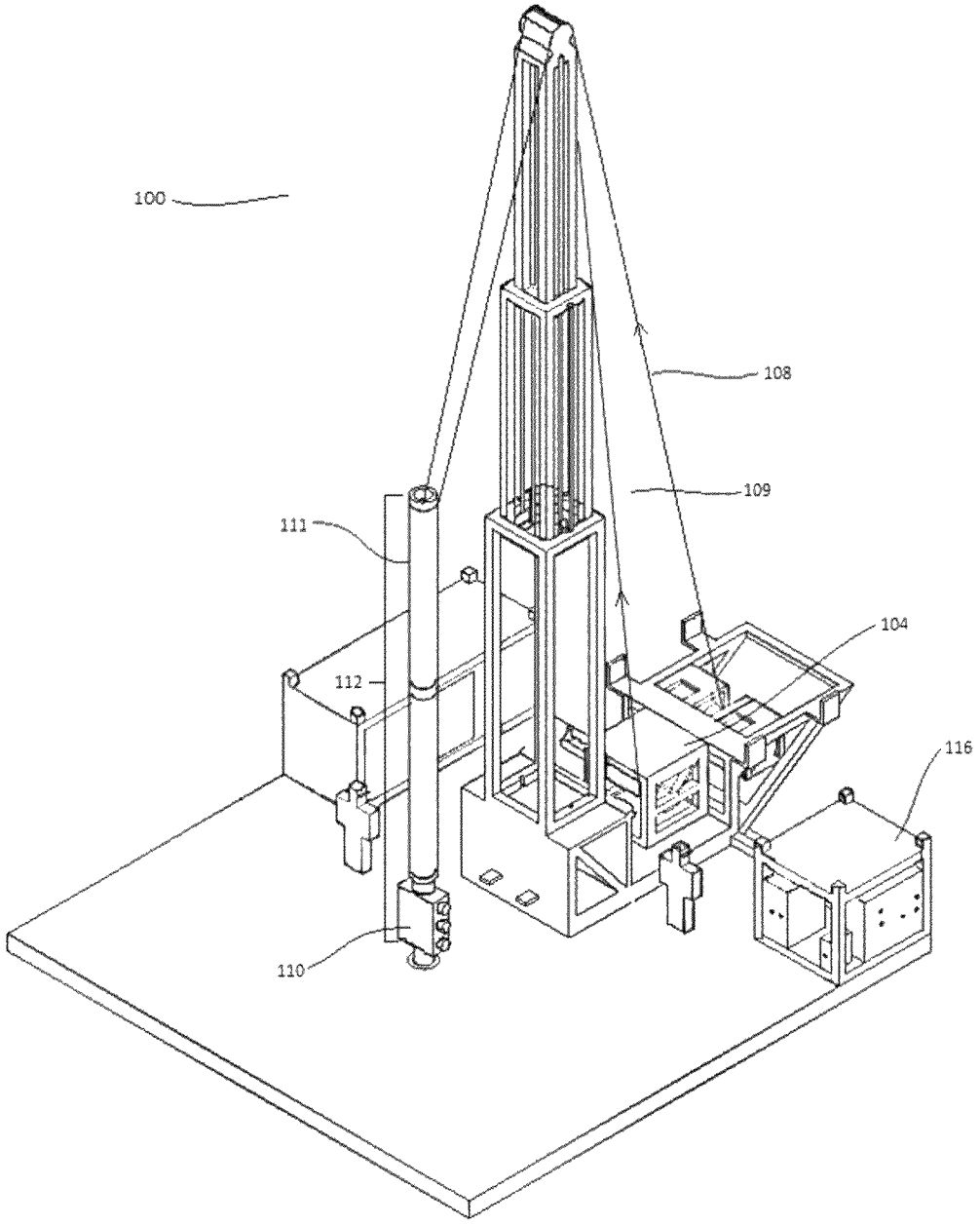
FIG. 1 is a perspective view of the miniature slickline unit in a deployed or operational state according to one or more embodiments.

Reference will now be made in detail to embodiments of the present disclosure, examples of which are illustrated in the accompanying drawing. In the drawings, like reference numerals have been used throughout to designate identical elements, where convenient. The following description is merely a representative example of such teachings.

The phrases "at least one of A, B, and C," "at least one of A, B, or C," and "at least one of A, B, and/or C" may be construed as only A, only B, only C, A and B, A and C, B and C, or A, B, and C.

One or more embodiments of the present disclosure provide a system, method, and apparatus for performing offshore slickline interventions using a compact, integrated unit. The system enables single-lift transport of mast, pressure control equipment (PCE), and wireline drum, reducing crane usage, setup time, and improving operational efficiency during multi-well offshore wireline campaigns.

According to one or more embodiments of the present disclosure, FIG. 1 diagrammatically illustrates a miniature slickline unit (MSU) in its deployed or operational state, providing flexibility for use in space-constrained offshore environments while maintaining full slickline intervention capability. Conventionally, a crane would be required to move the wireline unit using one or two lifts, and the mast and any PCE equipment using two or three lifts. According to one or more embodiments, one or more wireline drums maybe securely mounted onto the mast structure, while allowing the PCE stack to be secured to the side and wireline valves to the front of the mast to allow for short single lifts from well to well.

According to one or more embodiments, a structural frame including a telescopic mast 100 is fully extended using hydraulic cylinders, reaching a height of approximately 90 feet and secured with locking mechanism, allowing for effective access to the wellbore for standard slickline operations. The wireline drum 104 may be configured to deploy at least one of one or more wireline cables, tugger lines or slicklines. At least one of the wireline cables, tugger lines or slicklines 108, 109 are routed upward from an integrated wireline drum 104 and tugger line drum including a spooling mechanism to control payout and retrieval of at least one of a wireline, a slickline, or one or more tugger lines securely onto the mast structure, passing over the crown sheave positioned at the top of the mast 100, each configured to perform independent lifting and handling operations. A primary tugger line 108 is operatively mounted on the mast structure 100 and is mechanically configured for the vertical lifting, lowering, and precise positioning of the main PCE stack 112, including but not limited to lubricators 111, wireline valves 110, wellhead flanges and other wellhead isolation tools. The primary tugger line 108 may be referred to as a "first tugger line." The PCE main stack 110 may be mounted on a side portion of the mast 100. The secondary tugger line 109 which can be a wireline, is independently controlled from the primary tugger line 108 and is dedicated to the operating of auxiliary well tools, such as tool strings, pulling tools, fishing equipment, and other downhole intervention tools. The secondary tugger line 109 may be referred to as a "second tugger line." A powerpack 116, essential for supplying hydraulic and electrical power to the system, may be incorporated within the assembly for providing the necessary energy for operations such as cable retraction, drum control, and operation of the tugger lines and wirelines. According to one or more embodiments, the deployed or operational state allows the unit to perform complete slickline operations independently, even in space-constrained offshore environments, while minimizing reliance on external platform cranes.

Figure 2:
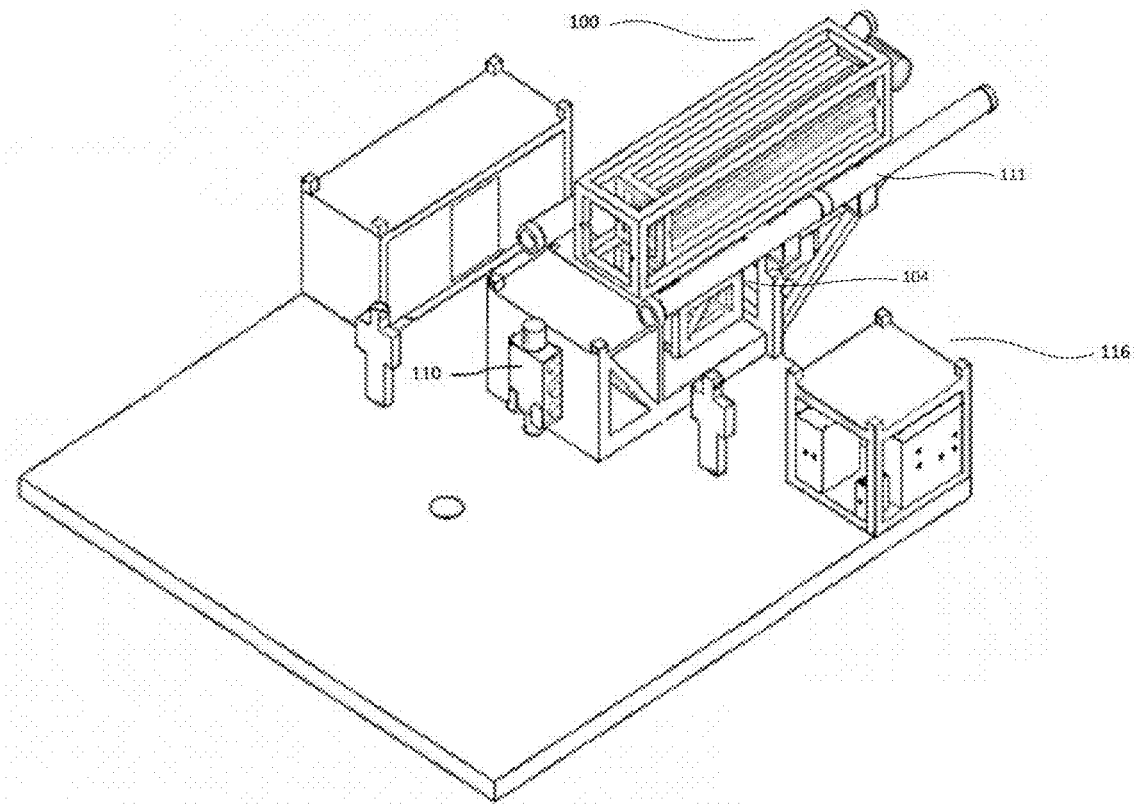
FIG. 2 illustrates the miniature slickline unit in a transport-ready state according to one or more embodiments.

As depicted in FIG. 2, the system diagrammatically illustrates a transport ready state for efficient relocation between wells during offshore slickline operations. According to one or more embodiments, a structural frame including a telescopic mast 100 is fully retracted using hydraulic cylinders and the multiple nested sections are folded into horizontal position with the structure secured using dedicated transport restraints (not shown). The integrated wireline drum 104, including a spooling mechanism, is mounted onto the mast 100 for ensuring proper weight distribution and preserving the structural integrity of the assembly during lifting. The PCE stack 112 is mounted to the side portion of the mast 100 during transport and one or more wireline valves 110 are mounted to the front portions of the mast 100 during transport using mounting points that secure the components to the mast 100 against movement and vibration. In addition, one or more lubricators 111 are positioned and fastened along either side of the mast, or on opposite sides of the mast 100 from each other, forming a balanced, compact load suitable for a single-lift crane operation. All critical subsystems, including the powerpack 116 and tugger line assemblies, remain integrated within the transport frame, eliminating the need for disassembly or modular breakdown. Accordingly, the mast 100, the wireline drum 104, the PCE stack 112, the one or more wireline valves 110, the one or more lubricators 111, and the powerpack 116 are integrated into a single structural frame (i.e. common frame) for offshore transport as a combined unit (i.e. single transportable unit), and the combined unit is configured to be lifted and relocated between one or more well sites via a single crane lift.

Figure 3:
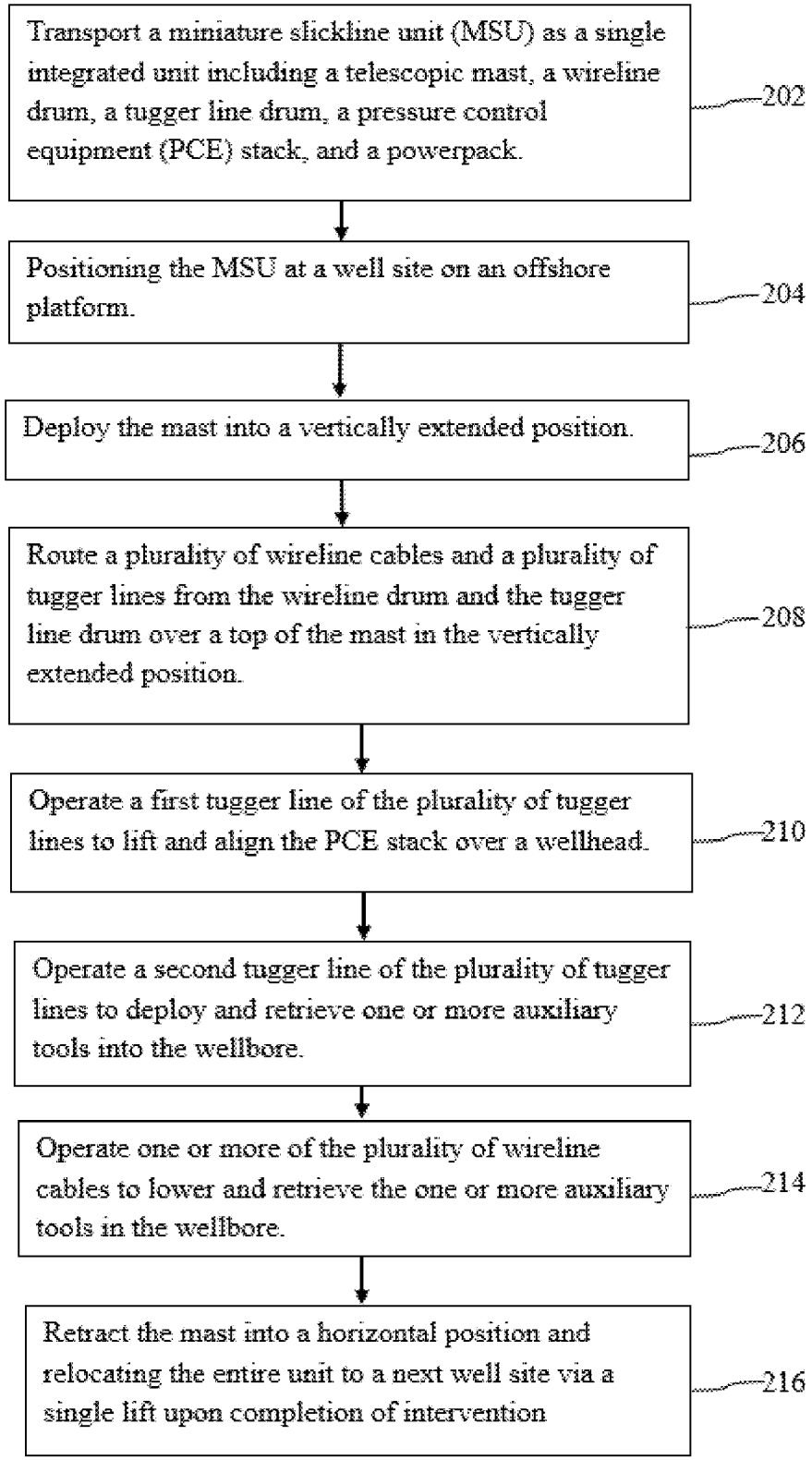
FIG. 3 illustrates a flowchart of a method for performing offshore slickline operations according to one or more embodiments.

According to one or more embodiments of the present disclosure, FIG. 3 illustrates a flowchart of a method for performing offshore slickline operations. The method includes transporting a miniature slickline unit (MSU) as a single integrated unit comprising a telescopic mast, a wireline drum, a tugger line drum, a pressure control equipment (PCE) stack, and a powerpack (202), positioning the MSU at a well site on an offshore platform (204), deploying the mast into a vertically extended position (206), routing a plurality of wireline cables and a plurality of tugger lines from the wireline drum and the tugger line drum over a top of the mast in the vertically extended position (208), operating a first tugger line of the plurality of tugger lines to lift and align the PCE stack over a wellhead (210), operating a second tugger line of the plurality of tugger lines to deploy and retrieve one or more auxiliary tools into the wellbore (212), operating one or more of the plurality of wireline cables to lower and retrieve the one or more auxiliary tools in the wellbore (214), and retracting the mast into a horizontal position and relocating the entire unit to a next well site via a single lift upon completion of intervention (216). The completion of intervention may be a time after the one or more of the plurality of wireline cables are lowered and the one or more auxiliary tools in the wellbore are retrieved. According to one or more embodiments, the operating of the first tugger line of the plurality of tugger lines to lift and align the PCE stack over a wellhead (210) may include aligning and latching the PCE stack onto a wellhead flange.

The configuration shown in FIG. 2 and the method shown in FIG. 3 is structured to comply with offshore lifting safety standards and is capable of being moved between wells via a single crane lift or like, significantly streamlining logistics compared to conventional offshore slickline systems which may require five to ten separate lifts. The system described in the present disclosure reduces setup complexity, minimizes crane dependency, and accelerates well-to-well transitions.

This transport-ready configuration enables wireline crews to rig-up and rig-down more efficiently, without extensive support from platform deck crews. As a result, overall intervention time is reduced, and platform crane resources are freed for other operations. The compact, consolidated assembly also enhances safety by minimizing manual handling and the number of lift operations, making it ideally suited for high-traffic, space-constrained offshore platforms involved in multi-well wireline intervention campaigns.

The foregoing disclosure describes one or more embodiments and is given by way of example only. The present disclosure is not limited to any of the specific features described herein but includes all variations thereof within the scope of the appended claims.

What is claimed is:

1. A system for performing offshore wireline interventions, comprising:

a telescopic mast disposable in a vertically extended configuration and in a horizontally retracted configuration;

a wireline drum mounted onto the mast, the wireline drum comprising a plurality of wireline cables;

a tugger line drum comprising a plurality of tugger lines;

a pressure control equipment (PCE) stack mounted on a side portion of the mast;

one or more wireline valves mounted on a front portion of the mast; and one or more lubricators mounted along the mast;

wherein in the mast vertically extended configuration, the plurality of tugger lines are routed from the tugger line drum over a top of the mast, and a first tugger line of the plurality of tugger lines is disposed to lift and align the PCE stack over a wellhead, and a second tugger line of the plurality of tugger lines is disposed to lower and retrieve one or more auxiliary tools in a wellbore; and wherein in the mast vertically extended configuration, at least one wireline cable of the plurality of wireline cables is routed from the wireline drum over the top of the mast, and is disposed to lower and retrieve the one or more auxiliary tools in the wellbore.

2. The system of claim 1, wherein the PCE stack is secured to a side portion of the mast in the mast horizontally retracted configuration, and the one or more wireline valves are mounted to a front portion of the mast during transport in the mast horizontally retracted configuration.

3. The system of claim 1, wherein the one or more lubricators comprises a plurality of lubricators, the plurality of lubricators being secured to either side of the mast or on opposite sides of the mast from each other.

4. The system of claim 1, further comprising an integrated powerpack configured to supply hydraulic and electrical power to the system.

5. The system of claim 4, wherein the mast, the wireline drum, the PCE stack, the one or more wireline valves, the one or more lubricators, and the powerpack are integrated into a single structural frame for offshore transport as a combined unit, and the combined unit is configured to be lifted and relocated between one or more well sites via a single crane lift.

6. An apparatus for offshore well intervention, comprising:

a structural frame comprising a telescopic mast movable between a vertically extended position and a horizontally retracted position;

a wireline drum mounted onto the mast;

a pressure control equipment (PCE) stack removably secured to a side section of the mast;

one or more wireline valves mounted to a front section of the mast;

a pair of lubricators secured to lateral sides of the mast;

a first tugger line configured to manipulate the PCE stack; and a second tugger line configured to operate one or more auxiliary well tools;

wherein the mast, the wireline drum, the PCE stack, the one or more wireline valves, the pair of lubricators, are mounted on the structural frame as a single unit transportable to an offshore well.

7. The apparatus of claim 6, further comprising one or more hydraulic cylinders; and wherein the mast comprises a plurality of nested sections, wherein the one or more hydraulic cylinders are configured to extend the plurality of nested sections to the mast vertically extended position, and configured to retract the plurality of nested sections to the mast horizontally retracted position.

8. The apparatus of claim 6, wherein the wireline drum and first tugger line are integrated and comprise a spooling mechanism configured to control payout and retrieval of at least one of a wireline, a slickline, or one or more tugger lines.

9. The apparatus of claim 6, wherein the PCE stack is secured to the side section of the mast in the mast horizontally retracted configuration, and the one or more wireline valves are mounted to the front section of the mast in the mast horizontally retracted configuration.

10. The apparatus of claim 6, wherein the pair of lubricators are secured to the lateral sides of the mast in the mast horizontally retracted configuration.

11. The apparatus of claim 6, wherein the first tugger line and second tugger line are independently controllable for separate lifting and handling operations.

12. The apparatus of claim 6, wherein the apparatus further comprises an integrated powerpack and the powerpack is configured to supply hydraulic and electrical power to the apparatus; and wherein the powerpack is mounted on the structural frame.

13. A method for performing offshore slickline operations, comprising:

transporting a miniature slickline unit (MSU) as a single integrated unit comprising a telescopic mast, a wireline drum, a tugger line drum, a pressure control equipment (PCE) stack, and a powerpack;

positioning the MSU at a well site on an offshore platform;

deploying the mast into a vertically extended position;

routing a plurality of wireline cables and a plurality of tugger lines from the wireline drum and the tugger line drum over a top of the mast in the vertically extended position;

operating a first tugger line of the plurality of tugger lines to lift and align the PCE stack over a wellhead;

operating a second tugger line of the plurality of tugger lines to deploy and retrieve one or more auxiliary tools into a wellbore;

operating one or more of the plurality of wireline cables to lower and retrieve the one or more auxiliary tools in the wellbore; and retracting the mast into a horizontal position and relocating the MSU to a next well site via a single lift upon completion of intervention.

14. The method of claim 13, wherein in the vertically extended position, the mast is vertically extended to a height of 90 feet via hydraulic actuation, and in a transport-ready state, the mast is retracted into a horizontal position.

15. The method of claim 13, wherein the operating the first tugger line comprises aligning and latching the PCE stack onto a wellhead flange.

16. The method of claim 13, wherein the second tugger line is independently controlled and is configured to rig-up and rig-down tool one or more downhole intervention tools.

17. The method of claim 13, wherein the plurality of wireline cables are independently controlled and configured to deploy and retrieve one or more downhole intervention tools.

18. The method of claim 13, wherein the wireline drum is mounted onto the mast, the PCE stack is secured to the side of the mast, and one or more wireline valves are mounted to the front of the mast.

19. The method of claim 18, wherein one or more lubricators are mounted on to opposing lateral sides of the mast to form a single-liftable unit.

20. The method of claim 19, wherein the MSU is a fully integrated unit and configured to enable transport, rig-up, and rig-down of the mast, the wireline drum, the tugger line drum, the PCE stack, the one or more wireline valves, the one or more lubricators, and the powerpack in a single lift.

* * * * *